US010328310B2

(12) United States Patent
Madson et al.

(10) Patent No.: US 10,328,310 B2
(45) Date of Patent: Jun. 25, 2019

(54) DIMPLE PATTERNS WITH SURFACE TEXTURE FOR GOLF BALLS

(71) Applicant: Acushnet Company, Fairhaven, MA (US)

(72) Inventors: Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/811,790

(22) Filed: Nov. 14, 2017

(65) Prior Publication Data

US 2018/0064998 A1 Mar. 8, 2018

Related U.S. Application Data

(63) Continuation-in-part of application No. 15/230,811, filed on Aug. 8, 2016, now Pat. No. 9,844,701, which is a continuation-in-part of application No. 15/047,785, filed on Feb. 19, 2016, now Pat. No. 9,713,746, which is a continuation of application No. 14/476,843, filed on Sep. 4, 2014, now Pat. No. 9,302,155.

(51) Int. Cl.
*A63B 37/00* (2006.01)
*A63B 37/14* (2006.01)

(52) U.S. Cl.
CPC ..... *A63B 37/0019* (2013.01); *A63B 37/002* (2013.01); *A63B 37/0004* (2013.01); *A63B 37/0005* (2013.01); *A63B 37/0006* (2013.01); *A63B 37/009* (2013.01); *A63B 37/0011* (2013.01); *A63B 37/0012* (2013.01); *A63B 37/0015* (2013.01); *A63B 37/0018* (2013.01); *A63B 37/0021* (2013.01); *A63B 37/0089* (2013.01); *A63B 37/0096* (2013.01); *A63B 37/14* (2013.01)

(58) Field of Classification Search
CPC ..... A63B 37/0015; A63B 37/0004; A63B 37/0011; A63B 37/14
See application file for complete search history.

(56) References Cited

U.S. PATENT DOCUMENTS

| | | | | |
|---|---|---|---|---|
| 4,284,276 | A | 8/1981 | Worst | |
| 4,787,638 | A | 11/1988 | Kobayashi | |
| 5,547,197 | A | 8/1996 | Pocklington | |
| 5,879,245 | A | 3/1999 | Hwang | |
| 6,176,793 | B1 | 1/2001 | Sullivan | |
| 6,475,106 | B1 * | 11/2002 | Green | A63B 37/0004 473/378 |
| 6,569,038 | B2 | 5/2003 | Sullivan | |
| 7,226,369 | B2 | 6/2007 | Aoyama et al. | |
| 7,250,012 | B1 | 7/2007 | Simonds | |

(Continued)

*Primary Examiner* — John E Simms, Jr.
(74) *Attorney, Agent, or Firm* — Margaret C. Barker

(57) ABSTRACT

The present invention provides a golf ball having an outer surface comprising a plurality of dimples covering greater than 70 percent of the outer surface, wherein a plurality of the dimples incorporate directional surface texturing therein. The directional surface texturing preferably comprises substantially parallel channels or protrusions formed within the dimples. The directional surface texturing can comprise of parallel linear channels or protrusions or parallel non-linear linear channels or protrusions.

18 Claims, 14 Drawing Sheets

(56) References Cited

U.S. PATENT DOCUMENTS

| | | | | |
|---|---|---|---|---|
| 7,722,484 | B2 | 5/2010 | Morgan et al. | |
| 7,867,109 | B2 | 1/2011 | Sullivan et al. | |
| 8,329,081 | B2 | 12/2012 | Morgan et al. | |
| 2001/0019974 | A1 | 9/2001 | Hanada | |
| 2003/0211903 | A1 | 11/2003 | Hanada | |
| 2004/0127306 | A1 | 7/2004 | Sato | |
| 2006/0281583 | A1* | 12/2006 | Sato | A63B 37/0004 473/351 |
| 2008/0261725 | A1* | 10/2008 | Olson | A63B 37/0007 473/384 |
| 2009/0280929 | A1 | 11/2009 | Doot | |
| 2012/0046132 | A1* | 2/2012 | Fitchett | A63B 37/0004 473/384 |
| 2012/0165130 | A1 | 6/2012 | Madson et al. | |
| 2012/0301617 | A1 | 11/2012 | Fitchett et al. | |
| 2013/0072325 | A1 | 3/2013 | Madson et al. | |
| 2013/0168896 | A1 | 7/2013 | Tutmark | |

* cited by examiner

DIMPLE PATTERNS WITH SURFACE TEXTURE FOR GOLF BALLS

RELATED APPLICATIONS

The present application is a continuation-in-part of U.S. application Ser. No. 15/230,811, filed, Aug. 8, 2016, currently pending, which is a continuation-in-part of U.S. application Ser. No. 15/047,785, filed, Feb. 19, 2016, and issued as U.S. Pat. No. 9,713,746, which is a continuation of U.S. application Ser. No. 14/476,843, filed on Sep. 4, 2014 and issued as U.S. Pat. No. 9,302,155, the disclosures of which are hereby incorporated by reference in their entirety.

FIELD OF THE INVENTION

This invention relates to golf balls, particularly to golf balls possessing unique dimple patterns including surface texture. More particularly, the invention relates to golf balls having dimples arranged on the outer surface for primary aerodynamic behavior and flight characteristics and surface texture for secondary aerodynamic behavior.

BACKGROUND OF THE INVENTION

Historically, dimple patterns for golf balls have had a variety of geometric shapes, patterns, and configurations. Primarily, patterns are laid out in order to provide desired performance characteristics based on the particular ball construction, material attributes, and player characteristics influencing the ball's initial launch angle and spin conditions. Therefore, dimple pattern development is a secondary design step that is used to achieve the appropriate aerodynamic behavior, thereby tailoring ball flight characteristics and performance attributes.

Aerodynamic forces generated by a ball in flight are a result of its velocity and spin. These forces can be represented by a lift force and a drag force. Lift force is perpendicular to the direction of flight and is a result of air velocity differences above and below the rotating ball. This phenomenon is attributed to Magnus, who described it in 1853 after studying the aerodynamic forces on spinning spheres and cylinders, and is described by Bernoulli's Equation, a simplification of the first law of thermodynamics. Bernoulli's equation relates pressure and velocity where pressure is inversely proportional to the square of velocity. The velocity differential, due to faster moving air on top and slower moving air on the bottom created by the ball's spin, results in lower air pressure on top and an upward directed force on the ball.

Drag is opposite to the direction of flight and orthogonal to lift. The overall drag force on a ball is attributed pressure drag and viscous or skin friction drag. A sphere is a bluff body, which is a somewhat inefficient aerodynamic shape. As a result, the accelerating flow field around the ball causes a large pressure differential with high-pressure forward and low-pressure behind the ball. The low pressure area behind the ball is also known as the wake. In order to minimize pressure drag, dimples provide a means to energize the flow field and delay the separation of flow, or reduce the wake region behind the ball. Skin friction is a viscous effect residing close to the surface of the ball within the boundary layer.

The industry has seen many efforts to maximize the aerodynamic efficiency of golf balls, through dimple distribution and other methods, though they are closely controlled by golf's national governing body, the United States Golf Association (U.S.G.A.). One U.S.G.A. requirement is that golf balls have aerodynamic symmetry. Aerodynamic symmetry allows the ball to fly with a very small amount of variation no matter how the golf ball is oriented when tested. Preferably, dimples cover the maximum surface area of the golf ball without detrimentally affecting the aerodynamic symmetry of the golf ball and the ability of the ball to roll smoothly.

In attempts to improve aerodynamic symmetry, many dimple patterns have been developed based on geometric shapes. These may include circles, hexagons, triangles, and the like. Other dimple patterns are based in general on the five Platonic Solids including icosahedron, dodecahedron, octahedron, cube, or tetrahedron. Yet other dimple patterns are based on the thirteen Archimedian Solids, such as the small icosidodecahedron, rhomicosidodecahedron, small rhombicuboctahedron, snub cube, snub dodecahedron, or truncated icosahedron. Furthermore, other dimple patterns are based on hexagonal dipyramids. Dimple properties such as number, shape, size, volume, edge angles and arrangement are often manipulated in an attempt to generate a golf ball that has improved aerodynamic properties.

Furthermore, secondary surface texture has been suggested to augment the dimples and further refine the aerodynamic properties of the ball. In fact, early golfers found that the feathery golf balls flew better after being played for a while. They then began to purposely roughen the surface to created improved aerodynamic properties.

Similarly, U.S. Pat. No. 4,787,638 to Kobayashi discloses a golf ball with a plurality of first dimples arranged substantially uniformly on the outer surface of the ball. The ball also includes a plurality of indentations which are smaller than the dimples and are also arranged substantially uniformly on the outer surface and inside the surfaces of the dimples. The indentations may be formed by grit blasting. Likewise, U.S. Publication No. 2012-0301617 teaches essentially the same micro surface roughness over the surface of the golf ball to affect aerodynamic properties of the ball.

U.S. Pat. No. 8,329,081 to Morgan discloses a method of forming a golf ball with secondary surface texture created on the fret areas of a ball. The secondary surface texture is created on the golf ball hob prior to the primary dimples being formed into the hob. When the dimples are formed, they largely obliterate the secondary surface texture except for the fret area and the perimeter of the dimples.

U.S. Pat. No. 6,569,038, to Sullivan discloses a ball having dimples with structures therein to energize or agitate the airflow over the dimpled surface to increase the aerodynamic performance of the ball. These structures include sub-dimples and radiating convex or concave arms emanating from the center of the dimple.

SUMMARY OF THE INVENTION

The present invention is directed to a golf ball having an outer surface comprising a plurality of dimples incorporating directions surface texturing. Preferably, the dimples on the golf ball cover greater than 70 percent of the outer surface and at least 20 percent of the dimples incorporate directional surface texturing therein. More preferably, the outer surface of the golf ball comprises less than 400 dimples and at least 50 percent of the dimples incorporate directional surface texturing therein. Most preferably, the outer surface of the golf ball comprises less than 360 dimples and all of the dimples incorporate directional surface texturing therein.

Preferably, the directional surface texturing is comprised of linear arrangements within the dimples. The linear arrangements are preferably a plurality of linear channels that are substantially parallel within the dimple. In another embodiment, the linear arrangements are a plurality of linear protrusions that are substantially parallel within the dimple.

In a preferred embodiment, the directional surface texturing is comprised of linear arrangements within a dimple that are disposed at an angle of between about 10 and 90 degrees with respect to the linear arrangements of an adjacent dimple. More preferably, the Linear arrangements are arranged at an angle of between about 30 and 90 degrees with respect to an adjacent dimple. In another preferred embodiment, there are no dimples on the ball that have an adjacent dimple with parallel linear arrangements.

It is preferred that the golf ball be comprised of a plurality of dimples incorporating linear channels or linear protrusions that have a maximum channel depth or height of less than ¼ of the dimple depth they are in. Moreover, the linear channels or protrusions have a length that is at least 5 times the channel or protrusion width. The channel or protrusion width can be substantially similar to depth or height, but is preferably at least 2 times greater than the depth or height. Also, the channels or protrusions are spaced apart such that the length between adjacent channels or protrusions is at least 2 times the width. The directional surface texturing preferably has a cross-sectional shape that is V-shaped, U-shaped, rectangular or other partial polygonal shape or any continuous curve defined by superposed curves such as those described in U.S. Publication No. 2012-0165130, which is incorporated by reference herein in its entirety.

The present invention is also directed to a golf ball having an outer surface comprising a plurality of dimples covering greater than 70 percent of the outer surface, wherein at least 20 percent of the dimples incorporate directional surface texturing comprised of 3 or more substantially parallel linear channels having a U-shaped cross-section with a depth of less than 0.005 inch. The channels are preferably formed by laser etching or machining the surface of the mold cavities that form the golf ball or by forming surface texturing on the hob that forms the mold cavities. Each of the dimples can contain between 3 and 200 linear channels, and more preferably, between 3 and 50 linear channels. Most preferably, the dimples contain between 3 and 25 linear channels.

Preferably, the dimples on the ball have a dimple radius of at least 0.2 inch and the linear channels have a channel radius between 0.001 and 0.08 inch, and more preferably 0.007 inch to 0.07 inch. The linear channels are relatively shallow compared to the depth of the dimple they are in, and preferably, have a channel depth of 0.0003 inch to 0.003 inch. More preferably, at least one of the linear channels within a dimple extends entirely across the dimple and intersects the dimple perimeter. It is also preferable that at least a plurality of the linear channels extends entirely across the dimple and intersect the dimple perimeter.

The dimples are preferably circular in plan shape and have a diameters of 0.11 inch to 0.22 inch, but could also be polygonal or other geometric shapes. The dimples can also be spherically shaped in cross section or have a cross section defined by a number of functions. Preferably, the golf ball has four or more diameters of dimples that have multiple dimple depths and edge angles. In one embodiment, each of the dimples has the same number of linear channels. In another embodiment, each dimple has the same number of linear channels and the channel widths vary according to dimple diameters. In yet another embodiment, the number of linear channels varies based on the dimple diameter. Still further, in another embodiment, the depth of the linear channels can vary depending on the depth of the dimple.

In another preferred embodiment of the present invention the golf ball comprises at least one dimple having a circular plan shape and non-linear directional surface texturing that is comprised of a plurality of channels that are non-linear and parallel when viewing the dimple perpendicular to the dimple edge plane. Preferably, the channels are arcuate, meaning they have an arc radius but the arc spans less than 180 degrees. Thus, the present invention excludes channels that create a closed loop within the dimple (such as circles which are 360 degrees, squares, triangles, or other closed paths). This embodiment is specifically directed to parallel line segments such as circular arcs of less than 180 degrees, splines, staggered line segments, etc.

The channels are determined to be parallel by defining the channel center line defined by the midpoint between the edges of the channels. Once the center lines are defined for two channels, the channels are parallel if the distance between the two channel center lines (the parallel distance $D_p$) is the same for every point along at least one of the channels. This means if the channels are the same shape and length the distance between the center lines will be the same for every point along each center line. However, where the channels are parallel but one of the lengths is less than the other length, the distance between the center lines will be the same for every point along the shorter channel only. In that case, a portion of the longer channel will not have an equivalent point of measure and the channels are still considered parallel.

In each embodiment of the present invention, every measurement of the parallel distance between two channels should be substantially equal for the channels to be considered substantially parallel.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

Figure 1:
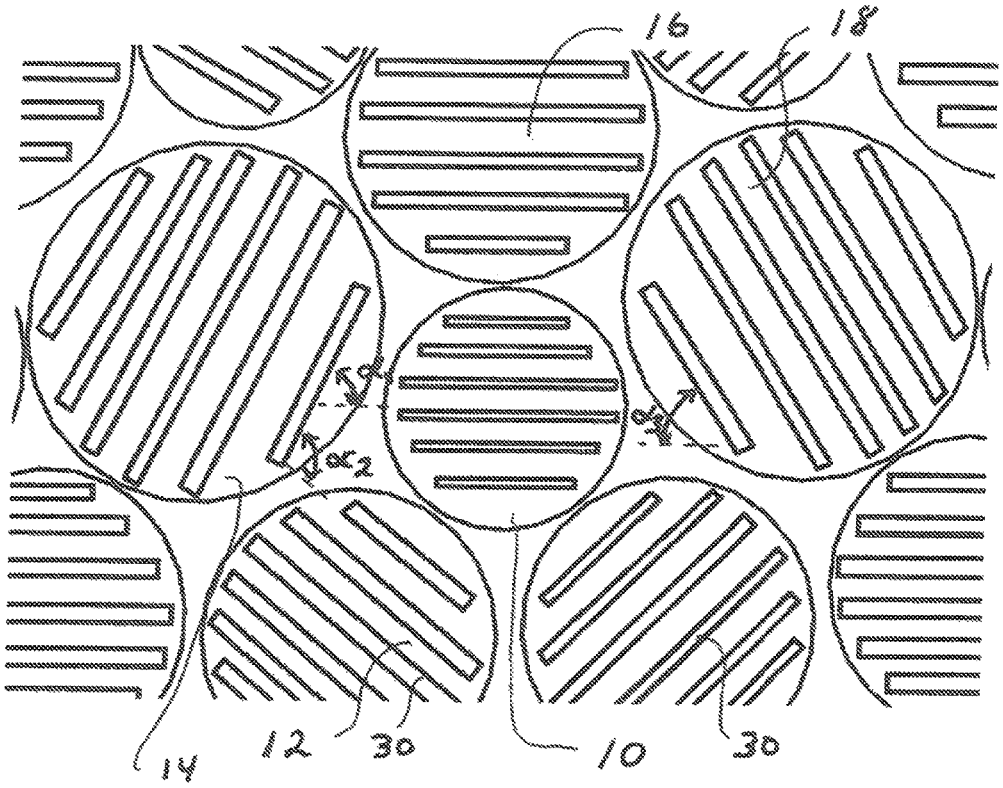
FIG. 1 illustrates a portion of a golf ball with directional surface texturing according to the present invention.

The present invention is directed to golf ball with improved dimples. The aerodynamic characteristics of a golf ball are largely dependent on the dimples of a golf ball and the way that the dimples are arrange. Golf balls typically include 250 to 450 dimples on the outer surface that range from about 0.08 to 0.2 inches in diameter, if circular. The way that these dimples are arranged over the outer surface, the shapes of the dimples and the edge angles of the dimples are all important to the overall flight performance of the golf ball. In FIG. 1, a plurality of dimples having directional surface texturing are disclosed. The dimples 10 through 20, for example, are adjacent dimples and have different dimple diameters. However, all of the dimples shown include a plurality of linear channels 30 therein.

Preferably, a golf ball according to the present invention has an outer surface comprising a plurality of dimples covering greater than 70 percent of the outer surface and at least 20 percent of the dimples incorporate directional surface texturing. Directional surface texturing is defined as a plurality of indentations or protrusions that form aligned arrangements within the dimple.

The outer surface of the golf ball preferably comprises less than 400 dimples of different sizes and, more preferably, at least 5 different sizes. In a preferred embodiment, at least 50 percent of the dimples incorporate directional surface texturing such as the linear channels 30 therein. The linear channels 30 are substantially parallel within the dimple. Preferably, there are between 2 and 6 linear channels within the dimples. Although FIG. 1 shows each of the dimples containing 6 linear channels, it is contemplated that smaller diameter dimples are likely to have less linear channels than larger diameter dimples. For example, in a preferred embodiment, a dimple having a diameter of less than 0.12 inch can have between 2 and 5 linear channels and a dimple having a diameter of 0.12 to 0.2 inch can have between 5 and 8 linear channels.

In a preferred embodiment of the invention, the outer surface of the golf ball comprises less than 360 dimples and all of the dimples incorporate directional surface texturing made up of substantially linear arrangements that are aligned. The linear arrangements, like the linear channels 30 disclosed in FIG. 1, are preferably substantially parallel to each other and extend across a substantial portion of the dimple. While the linear channels 30 shown in FIG. 1 are parallel within each dimple, they are at offset angles $\alpha$ with respect to adjacent dimples. The linear channels 30 within a dimple are disposed at angles of between about 10 and 90 degrees with respect to the linear channels 30 of an adjacent dimple. For example, dimple 10 includes linear channels that are disposed at an angle $\alpha$ of between 10 and 90 degrees with respect to each of the adjacent dimples 12, 14, 18 and 20. As shown, the linear channel angles $\alpha_1$ and $\alpha_2$ are about 60 degrees and $\alpha_3$ is about 90 degrees. Preferably, the linear channels 30 are arranged at an angle $\alpha$ of between about 30 and 90 degrees with respect to most of the adjacent dimples. In some arrangements, the golf ball can be designed such that no dimple on the ball has an adjacent dimple with parallel linear arrangements.

Figure 2:
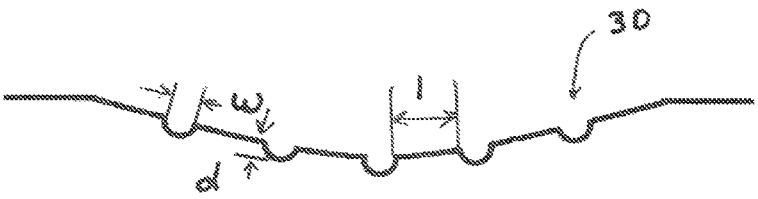
FIG. 2 illustrates a cross-sectional view of a dimple incorporating directional surface texturing according to the present invention.
Figure 7:
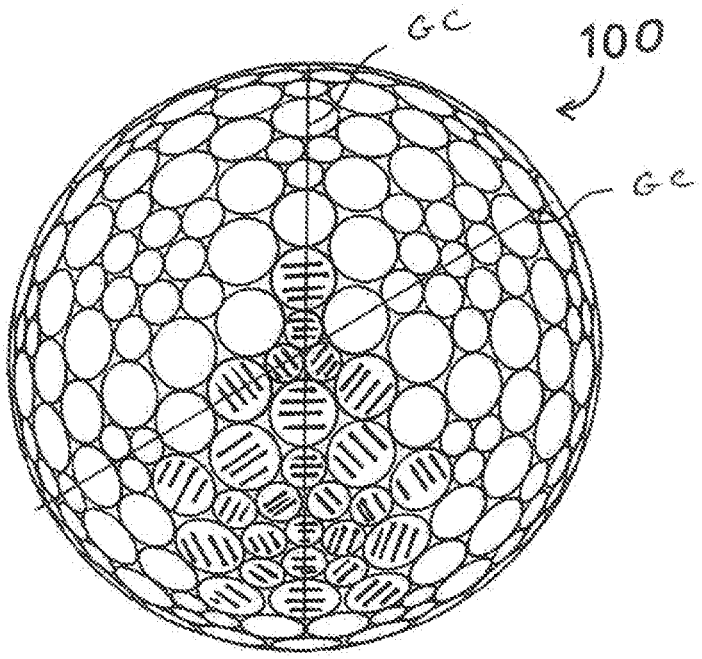
FIG. 7 illustrates a golf ball formed according to the present invention.

Referring to FIG. 2, a cross-section of a dimple is shown. The dimple depth, volume and edge angles of the dimples are measured as set forth in U.S. Pat. No. 7,226,369, as shown in FIG. 7 and discussed in col. 11, line 64 through, col. 12, line 46, which is incorporated by reference herein. The surface texturing is relatively small in comparison to the dimple and intended as a secondary aerodynamic function as discuss below. For example, preferably, the linear channels 30 have a maximum channel depth d of less than ¼ of a dimple depth. Linear protrusions within a dimple would be the inverse of the linear channels 30 shown. More preferably, the directional surface texturing depth (or protrusion height, if reversed) is less than about 0.002 inches. Also, the directional surface texturing has a width w, such as the channel width shown, that is equal to or greater than the depth and preferably greater than about twice the depth d. Further, the length between the directional surface texturing, shown as l, is preferably equal to or greater than the width w. Preferably, the length l is greater than twice the width w. Where FIG. 2 discloses a substantially U-shaped cross-section, it is preferred that the cross-section of the channels 30 be V-shaped, U-shaped, rectangular or other partial polygonal shape or any continuous curve defined by superposed curves such as those described in U.S. Publication No. 2012-0165130.

Further, the directional surface texturing is substantially elongated. The lengths of the directional surface texturing elements are preferably greater than 5 times the widths and extend substantially across the dimples. For example, the lengths of the linear channels 30 are preferably greater than 5 times the channel widths w and extend substantially across the dimples as shown. If a dimple is about 0.15 inches, the directional surface texturing in the center of the dimple preferably has a length of at least 0.1 inch, and more preferably, about 0.11-0.13 inch. The same directional surface texturing preferably has a width of less than about 0.02. Similarly, smaller dimples having a diameter of about 0.11 inch may have directional surface texturing with a length of about 0.08 to 0.09 inch. Preferably, the width of the directional surface texturing will be approximately the same as the surface texturing in the larger dimples. The table below is an example of a preferred dimple pattern incorporating linear channels as the directional surface texturing.

TABLE 1

| Dimple Diameter (in) | Number of Dimples | Number of Channels/Dimple | Channel Width (in) | Channel Depth (in) |
|---|---|---|---|---|
| 0.115 | 12 | 4 | 0.01 | 0.002 |
| 0.155 | 20 | 5 | 0.01 | 0.002 |
| 0.160 | 40 | 5 | 0.01 | 0.002 |
| 0.165 | 50 | 5 | 0.01 | 0.002 |
| 0.170 | 60 | 5 | 0.01 | 0.002 |
| 0.175 | 80 | 6 | 0.01 | 0.002 |
| 0.180 | 70 | 6 | 0.01 | 0.002 |

The present invention also provides a method for arranging dimples with directional surface texturing on a golf ball surface. The method includes creating sections on the surface of a golf ball. Preferably, the sections are polyhedrons or portions thereof and then filling the sections with dimples incorporating directional surface texturing. Each of the sections can contain a different arrangement of the directional surface texturing. For example, as discussed with FIG. 1 above, the dimples 10-20 all contain directional surface texturing that is oriented at an angle with respect to an adjacent dimple. This arrangement of the directional surface texturing provides that the ball has a uniform secondary aerodynamic characteristic regardless of the direction the ball is oriented.

Referring to FIGS. 3-12, a dimple pattern can be formed by choosing control points of a polyhedron, connecting the control points with a non-straight sketch line, patterning the sketch line in a first manner to generate an irregular domain, optionally patterning the sketch line in a second manner to create an additional irregular domain, packing the irregular domain(s) with dimples, and tessellating the irregular domain(s) to cover the surface of the golf ball in a uniform pattern. The control points can include the center of a polyhedral face, a vertex of the polyhedron, a midpoint or other point on an edge of the polyhedron, and others. The method ensures that the symmetry of the underlying polyhedron is preserved while minimizing or eliminating great circles due to parting lines from the molding process.

Figure 3:
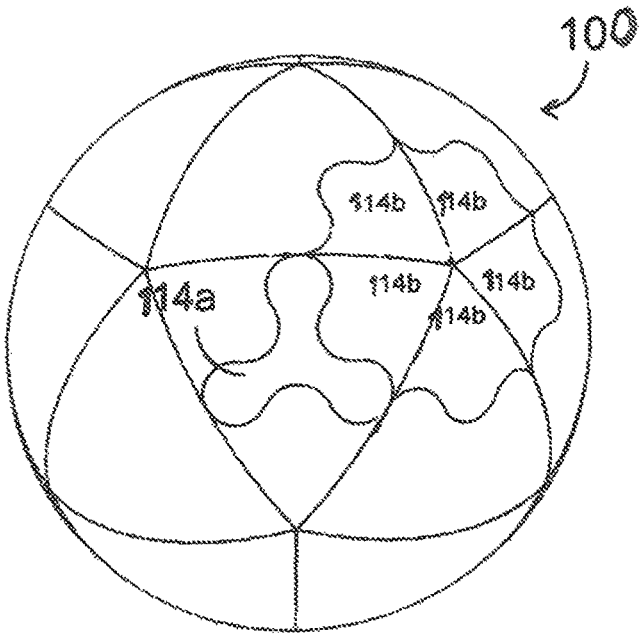
FIG. 3 illustrates a first domain and a second domain formed in an icosahedron face projected on a sphere.
Figure 4:
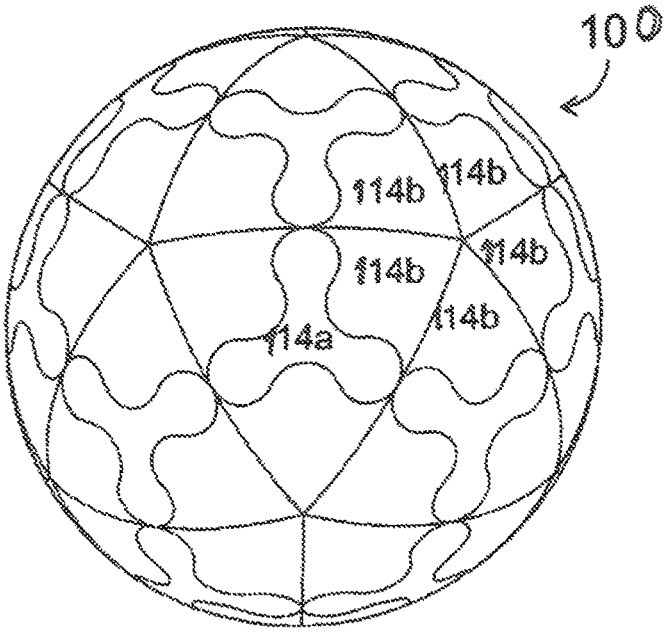
FIG. 4 illustrates the domains of FIG. 3 tessellated to cover the surface of a sphere.

Referring to FIGS. 3-7, a golf ball outer surface can be divided into equal sections by the projections of an icosahedron. Each icosahedron can then be divided by a midpoint to midpoint method, for example, to yield two domains that are tessellate to cover the surface of golf ball 100 as shown in FIGS. 3 and 4. The two domains are shown as 114*a* and 114*b*. The method of forming the different sections and then tessellating them over the surface of a golf ball to create different dimple patterns formed from such sections is set forth in U.S. application Ser. No. 13/675,041, which published as Publication No. 2013-0072325 on Mar. 21, 2013, and which is incorporated by reference in its entirety herein.

Figure 5:
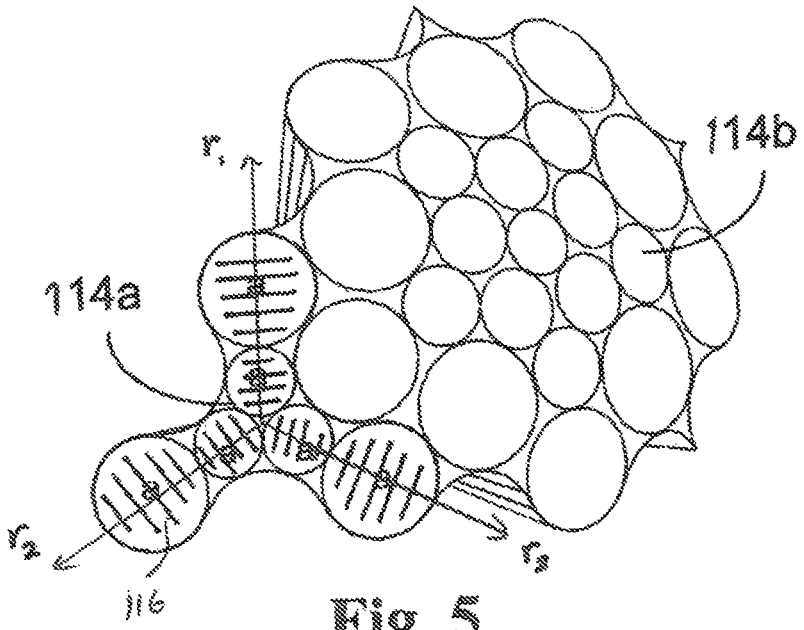
FIG. 5 illustrates a first portion of a golf ball dimple pattern formed according to the present invention.
Figure 6:
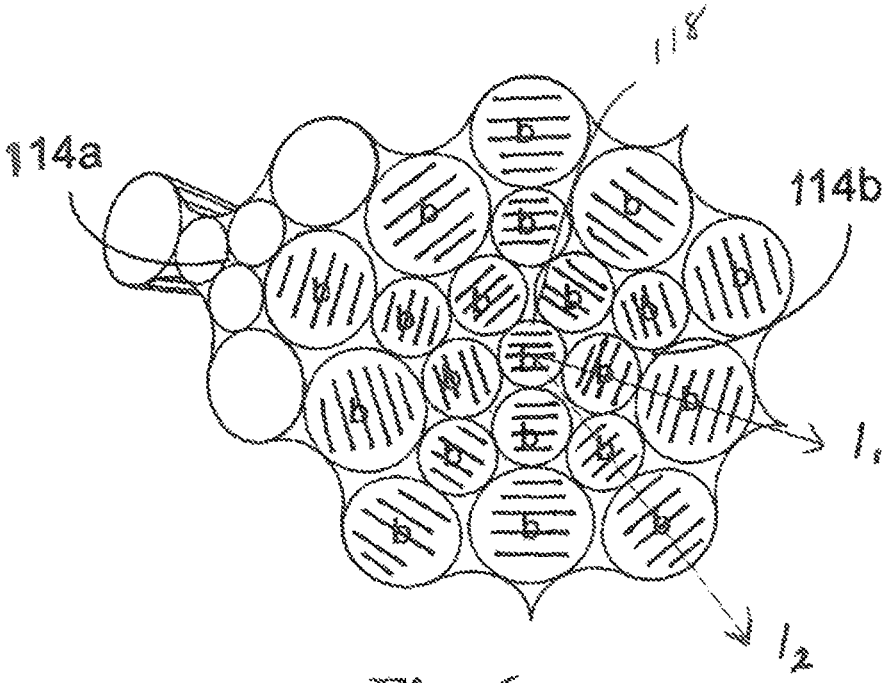
FIG. 6 illustrates a second portion of a golf ball dimple pattern formed according to the present invention.

Referring to FIGS. 5 and 6, the sections 114*a* and 114*b* are then filled with directional surface texturing. Elongated, linear protrusions 116 are formed within each dimple such that within the dimple, they are substantially parallel. The protrusions preferably have similar dimensions to the channels discussed above.

In a first section, set forth in FIG. 5, the directional surface texturing can be formed by selecting a midpoint of the section and then forming the linear elements perpendicular to the radii $r_1$-$r_3$ that emanate from the center. Similarly, in FIG. 6, the directional surface texturing is formed by forming protrusions that are perpendicular to the lines $l_1$ and $l_2$ emanating from the center dimple 118. In this manner, as shown in FIG. 7, each of the dimples in the sections will have an adjacent dimple with directional surface texturing at an angle between 10 and 90 degrees with respect thereto. This pattern will also form a plurality of great circles GC over the surface of the ball that intersect dimples incorporating directional surface texturing oriented perpendicular thereto.

Figure 8:
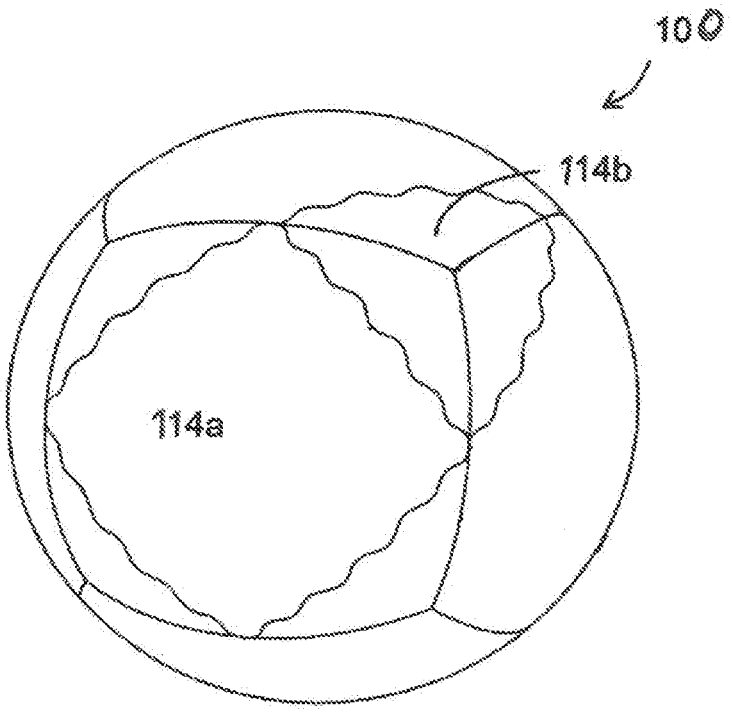
FIG. 8 illustrates a first domain and a second domain formed in a cube face projected on a sphere.
Figure 9:
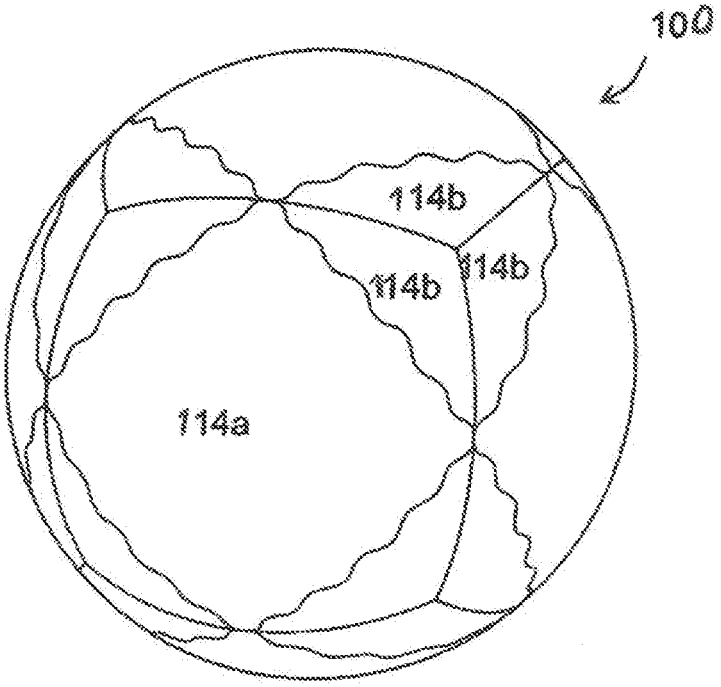
FIG. 9 illustrates the domains of FIG. 8 tessellated to cover the surface of a sphere.

Referring to FIGS. 8-12, a golf ball outer surface can be divided into equal sections by the projections of a cube. Each cube can then be divided by a midpoint to midpoint method, for example, to yield two domains that are tessellate to cover the surface of golf ball 100 as shown in FIGS. 8 and 9. The two domains are shown as 114*a* and 114*b*. Again, the method of forming the different sections and then tessellating them over the surface of a golf ball to create different dimple patterns formed from section is set forth in U.S. application Ser. No. 13/675,041.

Figure 10:
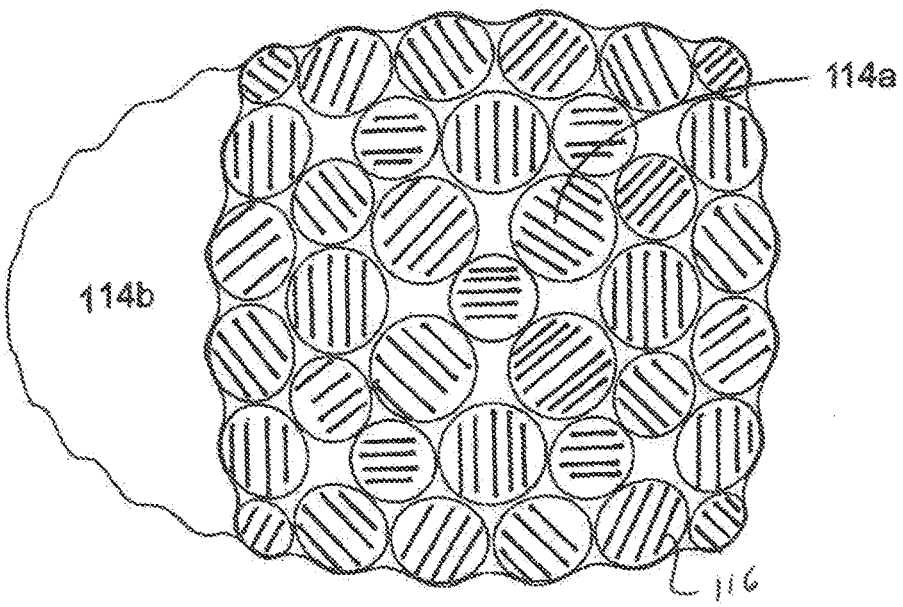
FIG. 10 illustrates a first portion of a golf ball dimple pattern formed according to the present invention.
Figure 11:
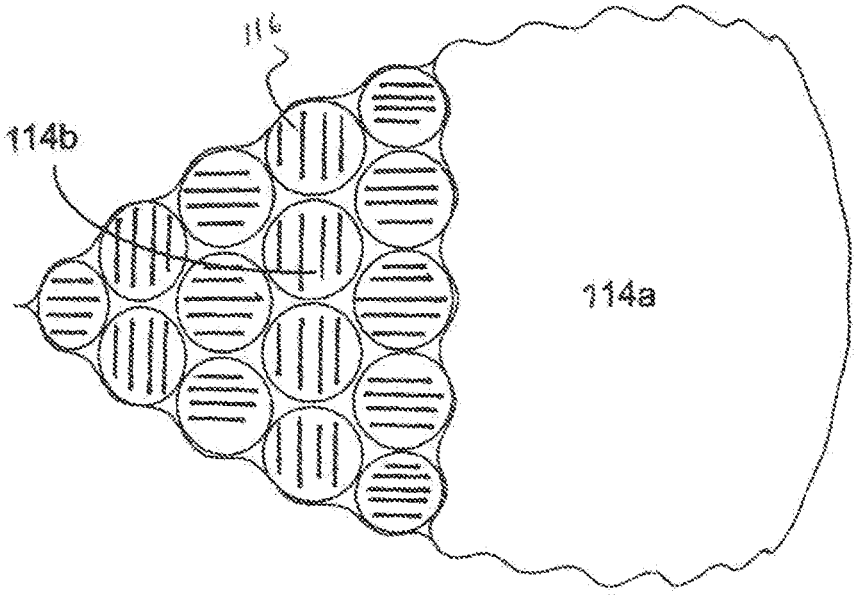
FIG. 11 illustrates a second portion of a golf ball dimple pattern formed according to the present invention.

Referring to FIGS. 10 and 11, the sections 114*a* and 114*b* are then filled with directional surface texturing 116. Elongated, linear protrusions 116 are formed within each dimple such that within the dimple, they are substantially parallel.

Figure 12:
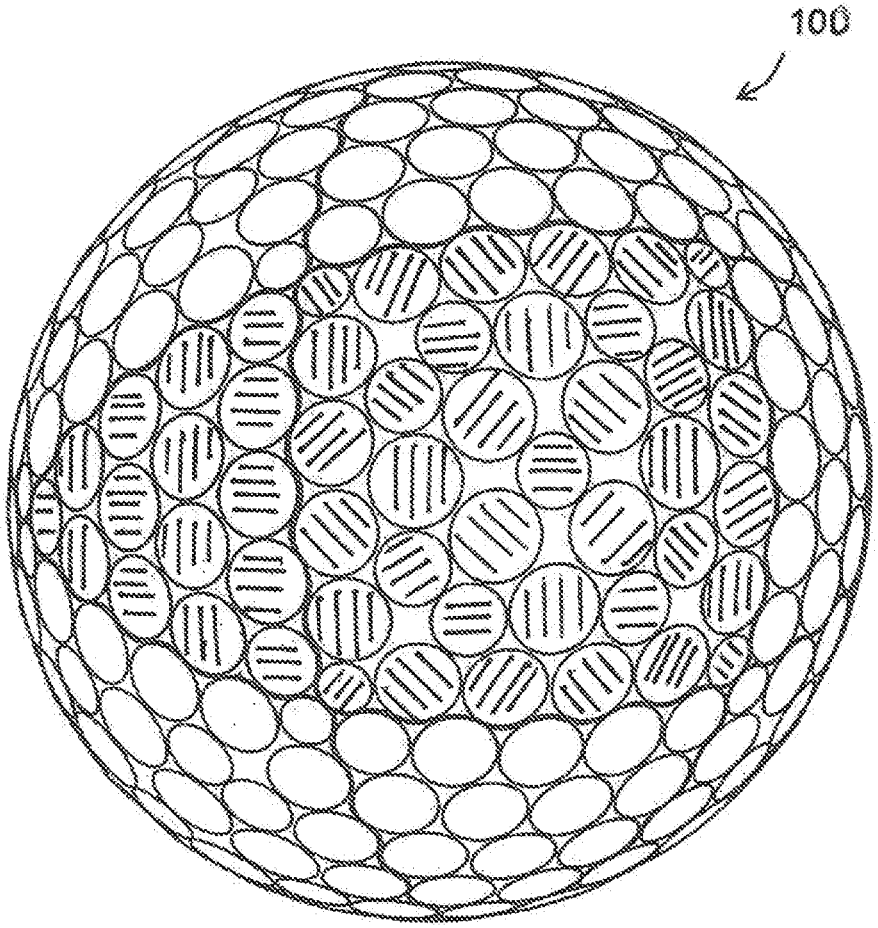
FIG. 12 illustrates a golf ball formed according to the present invention.

In a first section, set forth in FIG. 10, the directional surface texturing 116 can be formed by forming the linear elements 116 such that they are oriented at about 45 degree angles with respect to the directional surface texturing in an adjacent dimple. Similarly, in FIG. 11, the directional surface texturing 116 is formed by forming linear elements that are substantially perpendicular with respect to those in an adjacent dimple. As shown in FIG. 12, this type of arrangement results in an overall ball that has no great circles that intersect dimples having directional surface texturing that is perpendicular to the great circle. However, every dimple on the ball 100 still has an adjacent dimple with directional surface texturing at an angle of about 30 to 90 degrees relative thereto.

Furthermore, the present invention also contemplates an improvement in the aerodynamic characteristics of the golf ball. In particular, it is an object of the invention to improve the aerodynamics at low Reynolds Numbers and low Spin Ratios with the directional surface texturing. The aerodynamic properties of a golf ball and improvements in those properties are specifically discussed in detail in U.S. Pat. No. 7,226,369, and particularly in col. 4-col. 10 and col. 12-col. 17, which is incorporated by reference herein in its entirety. More particularly, the golf ball dimple pattern preferably comprises less than 370 dimples and more preferably less than 360 dimples covering over 75% of the outer surface of the ball and containing directional surface texturing within each dimple. More particularly, the golf ball preferably has a coefficient of lift at a Reynolds No. of 70,000 and Spin ration of 0.188 of greater than 0.24 and more preferably greater than 0.25. Moreover, the golf ball preferably has a coefficient of drag at a Reynolds No. of 70,000 and Spin Ratio of 0.188 of less than 0.27.

Figure 13:
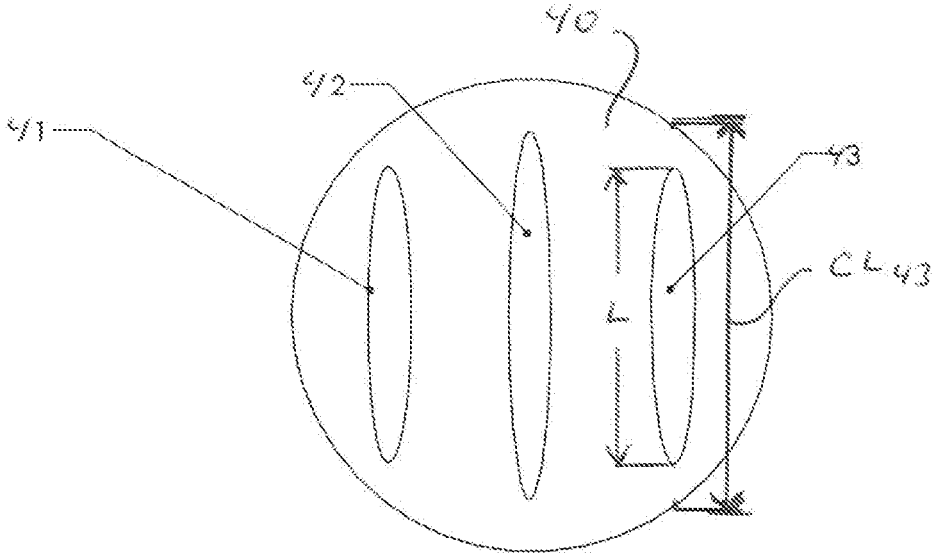
FIG. 13 illustrates a dimple having directional surface texturing.
Figure 14:
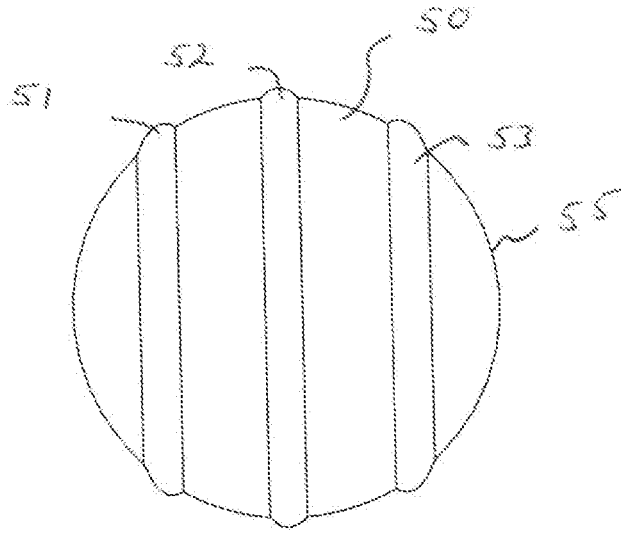
FIG. 14 illustrates a dimple having directional surface texturing.
Figure 15:
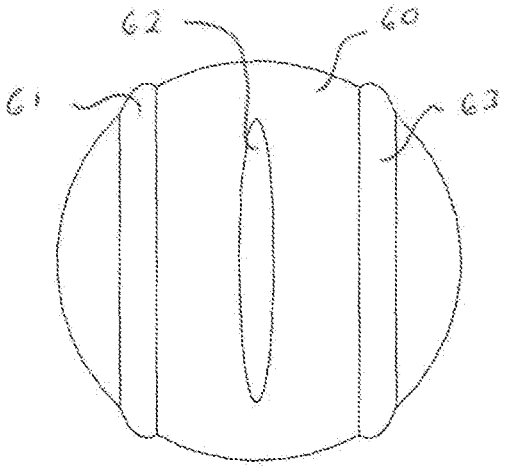
FIG. 15 illustrates a dimple having directional surface texturing.

Referring to FIGS. 13-16, dimples 40, 50 and 60 all have 3 or more substantially parallel linear channels (or protrusions) 41-43, 51-53 and 61-62, respectively. Preferably, the linear channels have a U-shaped cross-section with a depth of less than 0.005 inch and a radius of at least 0.001 inch. The channels are preferably formed by laser etching or machining the surface of the mold cavities that form the golf ball or by forming surface texturing on the hob that forms the mold cavities. In FIG. 13, the linear channels 41-43 do not extend across the dimple. Preferably, the channels have a length L that is greater than 50% of the chord length CL. For example, the linear channel 42, at the center of the dimple, extends greater than 50% of the dimple diameter. In FIG. 14, the linear channels 51-53 extend entirely across the width of the dimple and intersect the dimple perimeter 55. Preferably, the linear channels have a length that is less than about 110% of the chord length of the dimple. Thus, for all linear channels, it is preferred that they extend between 50% and 110% of the chord length of the dimple. More preferably, the linear channels have a length of between 80% and 105% of the dimple chord length extending through the length of the channel. Referring to FIG. 15, the dimple includes linear channels 61-63. The channel(s) 62 at the center of the dimple preferably does not extend across the width of the dimple such that it does not intersect an adjacent dimple. Thus the center channels, in this embodiment, can extend between about 50% and 95% of the dimple chord length (diameter). However, the perimeter channels, 61 and 63, extend greater than 100% of the chord length such that they would extend into fret area. Center linear channels are defined as those linear channels that are closer to the center of the dimple than the side perimeter, whereas perimeter linear channels are those channels that are closer to the side perimeter than the center. Preferably, the dimples and the linear channels cover at least 70% of the dimple outer surface, and more preferably, between 82% and 95%.

Figure 16:
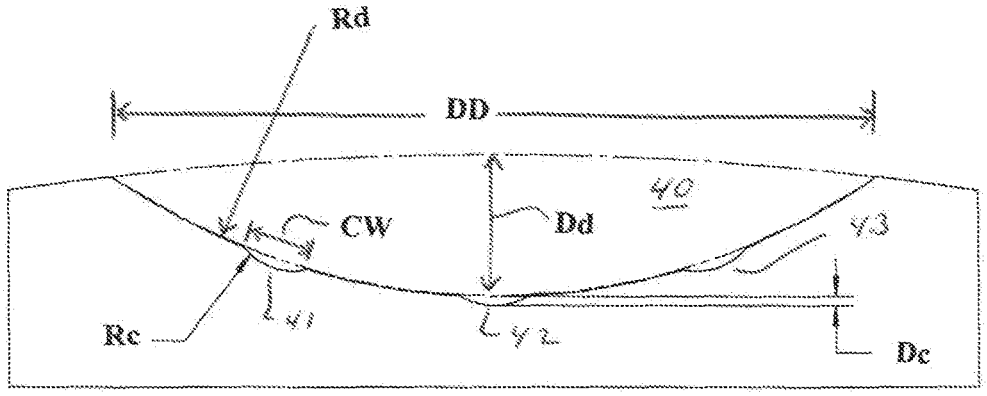
FIG. 16 illustrates a cross-section of a dimple having directional surface texturing.

Referring to FIG. 16, the dimples on the ball have a dimple radius Rd of at least 0.2 inch, and more preferably between about 0.2 inch and 1.4 inch. The linear channels have a channel radius Rc of between 0.001 inch and 0.08 inch. Furthermore, the linear channels have a channel depth Dc of between 0.0003 inch and 0.005 inch. More preferably, the linear channel depth Dc is between 0.0003 inch and 0.003 inch, and most preferably, between 0.0005 inch and 0.003 inch. In one embodiment, the linear channel depth Dc can be greater in the center linear channels than in the perimeter linear channels.

The dimples are preferably circular and have a dimple diameter DD of 0.11 inch to 0.22 inch, but the dimples could also be hexagons or other geometric shapes. The linear channels are relatively shallow compared to the depth of the dimple they are in, and preferably, have a channel depth Dc that is less than 1/10 of the dimple depth DD as measured from the phantom curved surface of the ball's outer surface.

Figure 17:
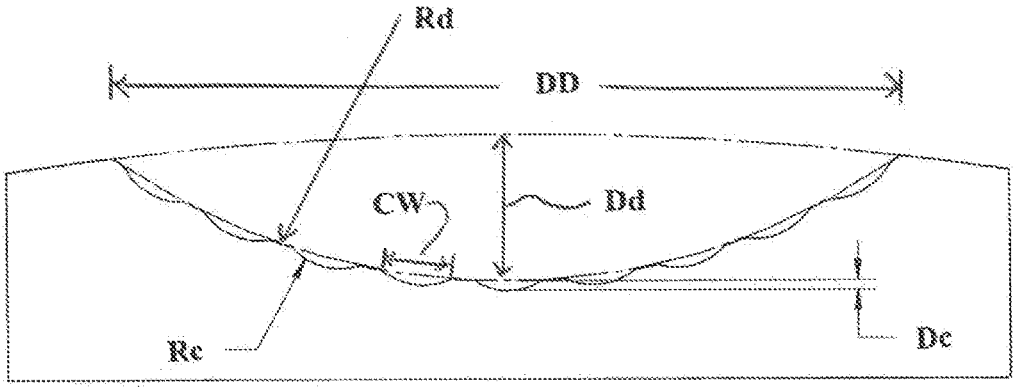
FIG. 17 illustrates a cross-section of a dimple having directional surface texturing.
Figure 18:
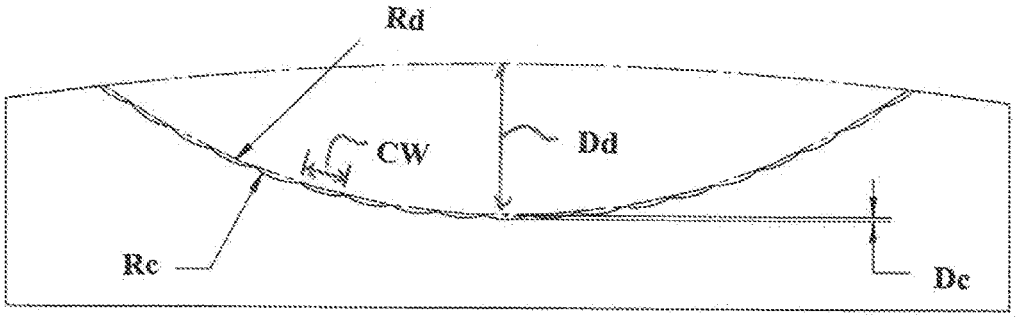
FIG. 18 illustrates a cross-section of a dimple having directional surface texturing.

Each of the dimples on the ball can contain between 3 and 200 linear channels, and more preferably, between 3 and 50 linear channels. Most preferably, the dimples contain between 3 and 25 linear channels. As shown in FIG. 17, the dimple can contain 9 linear channels. In this case, the channel width CW is greater than the length between channels, whereas in FIG. 16, when there are only 3 linear channels, the length between channels is greater than the channel width CW. FIG. 18 illustrates an embodiment where there are 19 linear channels and the linear channels essentially abut one another through the bottom surface of the dimple.

Table II below describes several embodiments of golf balls according to the present invention wherein every dimple has directional surface texturing as described:

TABLE II

| Embodiment | # Dimples | # Channels/ Dimple | Channel Radius (in) | Channel Depth (in) | % Chord Length |
|---|---|---|---|---|---|
| 1 | 352 | 3 | 0.02 | 0.002 | 70 |
| 2 | 352 | 3 | 0.02 (center) | 0.002 | 70 |
| | | | 0.02 (perimeter) | 0.001 | 105 |

TABLE II-continued

| Embodiment | # Dimples | # Channels/ Dimple | Channel Radius (in) | Channel Depth (in) | % Chord Length |
|---|---|---|---|---|---|
| 3 | 352 | 9 | 0.02 | 0.002 | 105 |
| 4 | 328 | 11 | 0.02 | 0.002 | 85 |
| 5 | 328 | 19 | 0.02 | 0.0008 | 95 |

The dimples on a golf ball according to the present invention are preferably circular in plan shape and have a diameters of 0.11 inch to 0.22 inch, but could also be n-sided polygons, where n is between 3 and 10, or other geometric shapes such as those that are defined by periodic functions along a simple path. Preferably, the golf ball has 4 or more diameters of dimples that have multiple dimple depths ranging from 0.005 to 0.03 and edge angles ranging from 10 degrees to 20 degrees.

In a preferred embodiment, each of the dimples on the golf ball has the same number of linear channels. For example, the golf ball can have about 300 to 360 dimples having dimple diameters from 0.11 inch to 0.22 inch. Each of the dimples can contain the same number of linear channels as set forth in Table II above. Preferably, in one embodiment, the width of the channels can vary with dimple diameter such that a dimple having a first diameter that is less than a second diameter of a second dimple has a first channel width that is less than a second channel width. For example, a dimple having a diameter of 0.11 inch can have channel widths of 0.011 inch and a dimple having a diameter of 0.18 inch can have channel widths of 0.018. Thus, the channel widths progressively increase with dimple diameter.

In another embodiment, each dimple on the golf ball has the number of linear channels therein based on the dimple diameter such that a dimple having a first diameter that is less than a second diameter of a second dimple has a first number of channels that is less than a second number of channels in the second dimple. For example, a golf ball can have all of the linear channels having a channel width of 0.02 inch and the number of channels in each dimple is dependent on the dimple diameter. In one example, a dimple having a diameter of 0.11 inch can have 5 linear channels and a dimple having a diameter of 0.18 inch can have 9 linear channels.

Still further, in another embodiment of the present invention, the depth of the linear channels can vary depending on the depth of the dimple. For example, the depths of the linear channels can be a function of dimple depth. In one embodiment, the channel depth can be about 1/10 of the dimple depth such that a dimple having a depth of 0.01 inch has a channel depth of 0.001 inch and a dimple having a depth of 0.02 has a channel depth of 0.002. In another embodiment, the depth of the channels is inversely proportional to the number of channels in a dimple. Thus a dimple can have 3 channels having a first depth and a second dimple can have 11 channels having a second depth that is less than the first depth.

In another preferred embodiment of the present invention the golf ball comprises at least one dimple having a circular plan shape and non-linear directional surface texturing that is comprised of a plurality of channels or protrusions that are non-linear and parallel when viewing the dimple perpendicular to the dimple edge plane as shown in FIGS. 19-24. Preferably, the channels or protrusions are arcuate, meaning they have an arc radius but the arc spans less than 180 degrees. For example, the arcs of non-linear channels 200, 201 and 202 in FIG. 19 span about 135 degrees. Thus, the present invention excludes channels that create a closed loop within the dimple (such as circles which are 360 degrees, squares, triangles, or other closed paths). As shown in FIGS. 19-24, dimples incorporating non-linear directional surface texturing are specifically directed to parallel line segments such as circular arcs of less than 180 degrees, splines, staggered line segments, etc.

Figure 19:
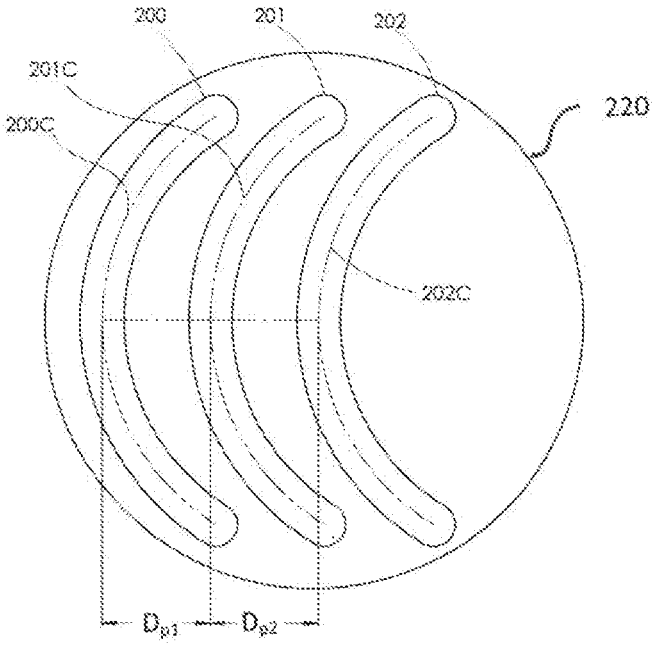
FIG. 19 illustrates a dimple having directional surface texturing.
Figure 20:
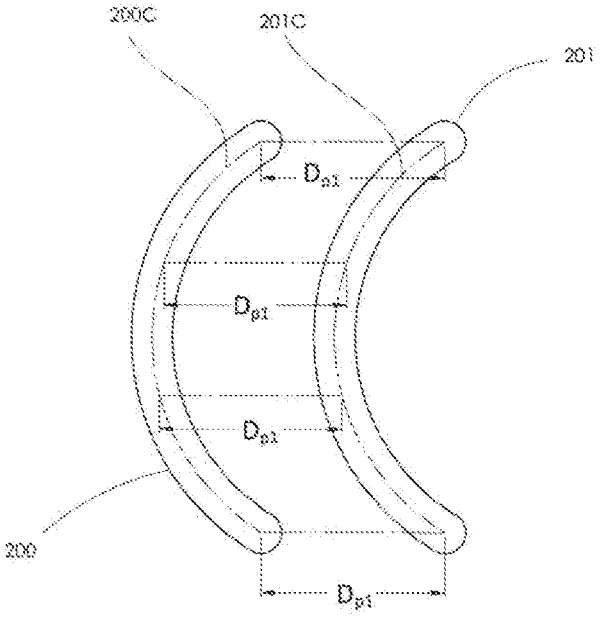
FIG. 20 illustrates the surface texturing of the dimple in FIG. 19.

Referring to FIGS. 19 and 20, the non-linear channels 200, 201 and 202 are determined to be parallel by defining the channel center line, 200C, 201C and 202C, defined by the midpoint between the edges of the channels. Once the center lines 200C, 201C and 202C are defined for two channels, the channels are parallel if the distance between the two channel center lines (the parallel distance $D_p$) is the same for every point along at least one of the channels. For example, the distance $D_{p1}$ shown in FIG. 20 is the same for every point in the channels. Thus, if the channels are the same shape and length the distance between the center lines $D_p$ will be the same for every point along each center line.

As shown in FIGS. 19 and 20, every measurement of the parallel distance $D_{p1}$ and $D_{p2}$ between two channels is substantially equal for the adjacent channels. If the largest parallel distance $D_p$ and the smallest parallel distance $D_p$ between two adjacent channels are substantially equal then the channels are parallel. As shown in FIG. 19, it is preferable that the dimples incorporating non-linear directional surface texturing have a circular plan shape and there are two or more parallel arc-shaped channels. In the dimple shown in FIG. 19, there are three non-linear parallel channels positioned within the perimeter of the dimple 220. All three channels 200, 201 and 202 are circular arcs that span approximately 135 degrees and are the same length. In FIG. 19, first channel 200 has a first channel centerline 200C, second channel 201 has a second channel centerline 201C, and third channel 202 has a third channel centerline 202C. The dimple diameter, D, in this particular example is about 0.15 inches. The channel centerlines are arcs having an arc radii, ar, equal to about 0.067 such that ar=0.45D The channel lengths, channel widths and channel depths for all channels incorporated herein should be as set forth above in reference to FIGS. 2, 16, 17 and 18, including the proportionality to the dimple diameters. More preferably, the channel width for the non-linear channels 200, 201 and 202 are all about 0.012 inches. However, while it is preferred that channel widths and channel depths remain constant within a dimple, it is contemplated that the channel widths and depths can differ by at least 0.002. For example, the channel width for channel 201 could be greater than the channel width for channels 200 and 202. The parallel distance $D_{p1}$ between the first channel 200 and the second channel 201 is approximately 0.03 inches and the parallel distance $D_{p2}$ between the second channel 201 and the third channel 202 is approximately 0.03 inches. However, $D_{p1}$ and $D_{p2}$ do not have to be equal.

FIG. 20 shows a close-up view of channels 200 and 201. There are four separate measurement of the parallel distance $D_{p1}$ at four different points along the channel centerlines 200C and 201C. All four measures of $D_{p1}$ are equal, and therefore, the channels 200 and 201 are parallel.

Figure 21:
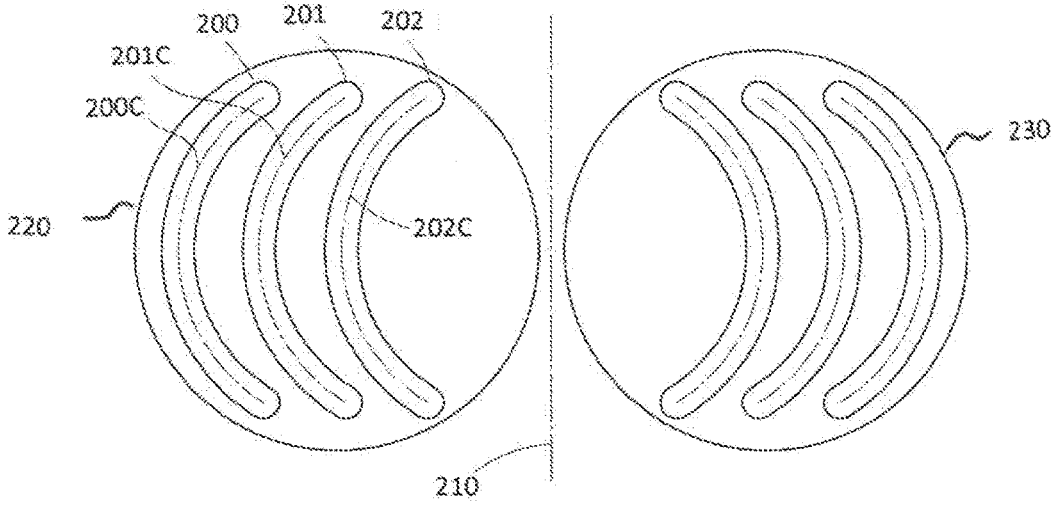
FIG. 21 illustrates multiple dimples having directional surface texturing.
Figure 22:
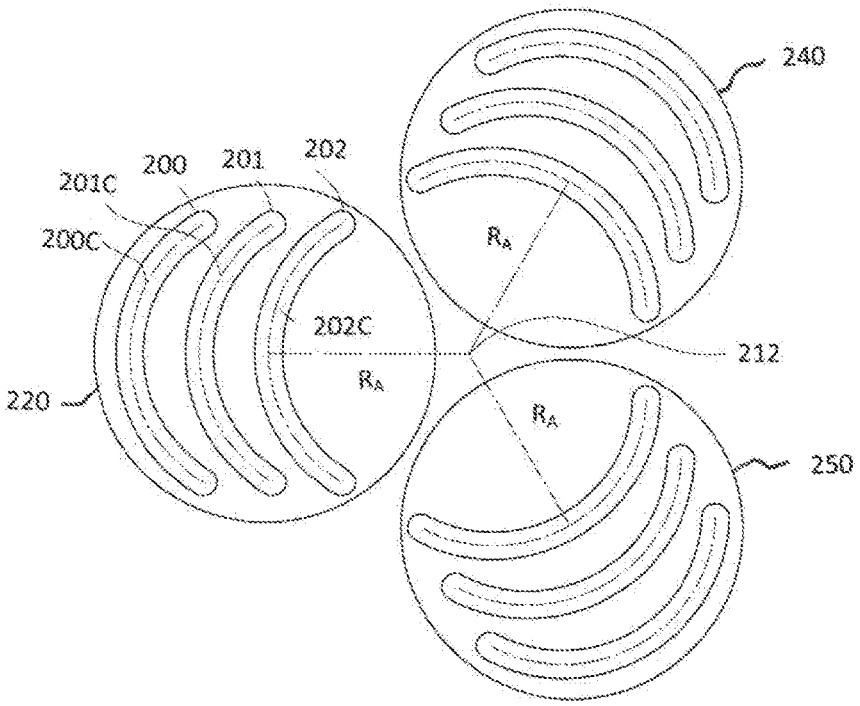
FIG. 22 illustrates multiple dimples having directional surface texturing.

In one particular embodiment of the invention, the dimples incorporating non-linear directional surface texturing having non-linear parallel channels do not have any adjacent dimples having non-linear directional surface texturing. In a further preferred embodiment as shown in FIG. 21, at least two dimples 220 and 230 having non-linear directional surface texturing have mirror symmetry about a centerline 210. In yet a further preferred embodiment as shown in FIG. 22, at least three dimples 220, 240 and 250 having non-linear directional surface texturing are rotationally symmetric about a centroid 212 of the dimples.

Figure 23:
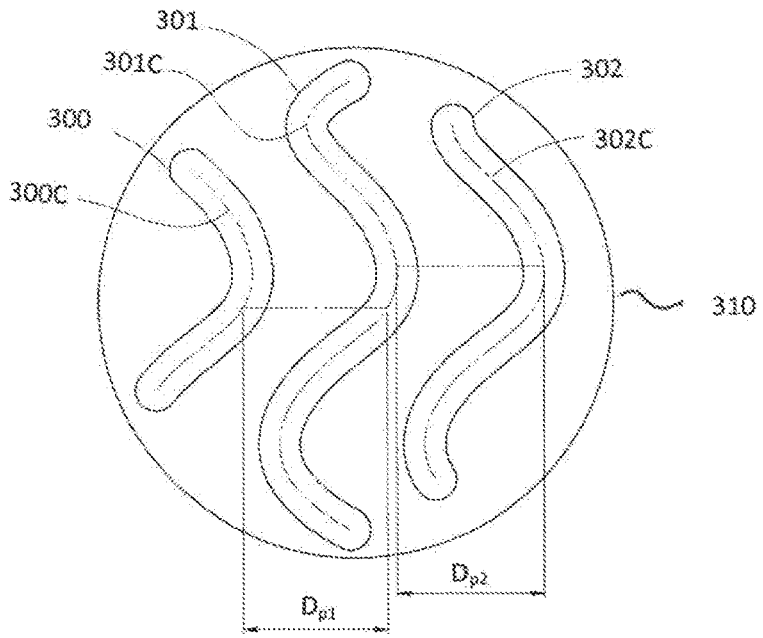
FIG. 23 illustrates a dimple having directional surface texturing.
Figure 24:
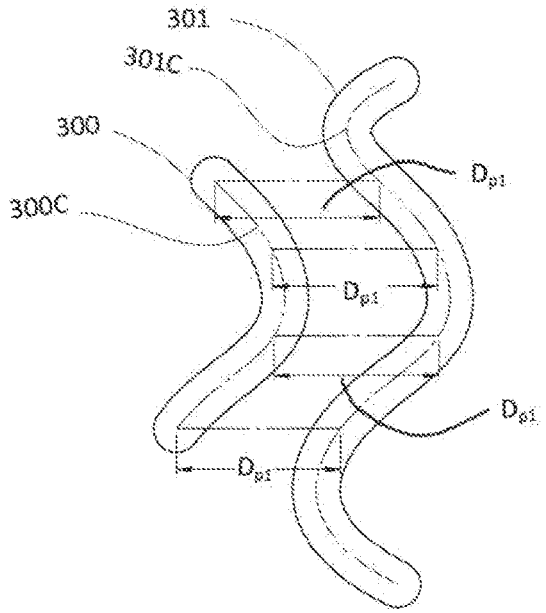
FIG. 24 illustrates the surface texturing of the dimple in FIG. 23.

In another preferred embodiment, the dimples can incorporate non-linear directional surface texturing where the non-linear channels are parallel but one of the lengths is less than the other length. Referring to FIGS. 23 and 24, dimple 310 incorporates parallel, non-linear channels 300, 301 and 302. As set forth above, the distance between the center lines 300C, 301C and 302C will be the same for every point along the shorter channel. Thus, in this case, a portion of the longest channel 301 will not have an equivalent point of measure in channels 300 and 302 and the channels are still considered parallel. In this particular example, the dimple diameter of dimple 310 is about 0.175 inches. The channel centerlines 300C, 301C and 302C are splines (piecewise polynomial parametric curves with all arcs spanning less than 180 degrees) of varying lengths. The channel width for all three channels is approximately 0.014 inches. The parallel distance $D_{p1}$ between the first channel 300 and the second channel 301 is equal to about 0.049 inches and the parallel distance $D_{p2}$ between the second channel 301 and the third channel 302 is equal to 0.049 inches. Again, $D_{p1}$ and $D_{p2}$ do not have to be equal, but are preferably the same.

FIG. 24 is a close-up view of channels 300 and 301. This figure shows four separate measurements of the parallel distance $D_{p1}$ at four different points along the channel centerlines 300C and 301C. All four measures are substantially equal showing that the channels 300 and 301 are parallel. In this example, every point of the centerline 300C has a corresponding point on centerline 301C at a parallel distance of $D_{p1}$, but not every point of 301C will have a corresponding point on 300C due to the centerlines having different lengths.

When numerical lower limits and numerical upper limits are set forth herein, it is contemplated that any combination of these values may be used. All numerical values and ranges set forth herein are approximate.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. For example, the dimples discussed herein are shown as circular dimples. However, it is understood that the present invention is intended to cover polygonal shaped dimples such as, for example, those disclosed in U.S. Pat. Nos. 7,722,484 and 7,867,109, which are incorporated by reference herein in their entirety. Further embodiments above are described with respect to including linear channels. However, it is easily appreciated that the channels can be formed as protrusions as well. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having an outer surface comprising a plurality of dimples covering greater than 70 percent of the outer surface, wherein at least one of the dimples incorporates non-linear directional surface texturing comprised of 2 or more substantially parallel, non-linear channels that have an arc radius (ar) and the arcs span less than 180 degrees.

2. The golf ball of claim 1, wherein the outer surface of the golf ball comprises less than 400 dimples and at least 20 percent of the dimples incorporate non-linear directional surface texturing therein.

3. The golf ball of claim 1, wherein the outer surface of the golf ball comprises less than 400 dimples and at least 50 percent of the dimples incorporate non-linear directional surface texturing therein.

4. The golf ball of claim 1, wherein a plurality of the dimples have non-linear channels that have a channel depth of less than 0.005 inch.

5. The golf ball of claim 1, wherein the at least one dimple has a dimple diameter (D) and the arc radius is related to the dimple diameter such that $4D \geq ar \geq 0.25$ D.

6. The golf ball of claim 1, wherein the plurality of non-linear channels have lengths that differ by at least 0.005 inches.

7. The golf ball of claim 1, wherein the plurality of non-linear channels have equal lengths.

8. The golf ball of claim 1, wherein the plurality of non-linear channels have equal channel widths.

9. The golf ball of claim 1, wherein the plurality of non-linear channels have channel widths that differ by at least 0.002 inches.

10. A golf ball having an outer surface comprising a plurality of dimples covering greater than 70 percent of the outer surface, wherein at least one of the dimples incorporates non-linear directional surface texturing comprised of 2 or more substantially parallel, non-linear channels, wherein the at least one dimple has a dimple diameter (D) and the non-linear channels are separated by a parallel distance ($D_p$) such that $D_p < \frac{1}{3}D$, wherein a plurality of dimples comprise non-linear directional surface texturing and each dimple having non-linear directional surface texturing has no adjacent dimples with non-linear directional surface texturing.

11. A golf ball having an outer surface comprising a plurality of dimples covering greater than 70 percent of the outer surface, wherein at least one of the dimples incorporates non-linear directional surface texturing comprised of 2 or more substantially parallel, non-linear channels, wherein the at least one dimple has a dimple diameter (D) and the non-linear channels are separated by a parallel distance ($D_p$) such that $D_p < \frac{1}{3}D$, wherein each dimple having non-linear directional surface texturing has at least one adjacent dimple with non-linear directional surface texturing, wherein a plurality of dimples having non-linear directional surface texturing have an adjacent dimple with non-linear directional surface texturing, wherein the dimples have mirror symmetry of each other about a midline separating the dimples.

12. A golf ball having an outer surface comprising a plurality of dimples covering greater than 70 percent of the outer surface, wherein at least one of the dimples incorporates non-linear directional surface texturing comprised of 2 or more substantially parallel, non-linear channels, wherein the at least one dimple has a dimple diameter (D) and the non-linear channels are separated by a parallel distance ($D_p$) such that $D_p < \frac{1}{3}D$, wherein each dimple having non-linear directional surface texturing has at least one adjacent dimple with non-linear directional surface texturing, wherein a plurality of dimple having non-linear directional surface texturing have two adjacent dimples with non-linear directional surface texturing, wherein the dimples are rotationally symmetric about a centroid of the dimples.

13. A golf ball having an outer surface comprising a plurality of dimples covering greater than 70 percent of the outer surface, wherein at least one of the dimples incorporates non-linear directional surface texturing comprised of 2 or more substantially parallel, non-linear channels, wherein a plurality of dimples comprise non-linear directional surface texturing and each dimple incorporating non-linear directional surface texturing is circular in plan shape and has a dimple diameter of 0.11 inch to 0.22 inch and the non-linear channels have a channel radius of 0.01 inch to 0.08 inch and a channel depth of 0.0003 inch to 0.003 inch.

14. The golf ball of claim 3, wherein each dimple incorporating non-linear directional surface texturing is circular in plan shape and has a diameter of 0.11 inch to 0.22 inch and the non-linear channels have a channel radius of 0.01 inch to 0.08 inch and a channel depth of 0.0003 inch to 0.003 inch.

15. The golf ball of claim 1, wherein a plurality of dimples comprise non-linear directional surface texturing and each dimple incorporating non-linear directional surface texturing is spherically shaped and has a dimple radius of 0.2 inch to 1.4 inch and the non-linear channels have a channel depth of 0.0003 inch to 0.003 inch.

16. The golf ball of claim 13, wherein each of the dimples incorporating non-linear directional surface texturing has the same number of non-linear channels.

17. The golf ball of claim 13, wherein each of the dimples incorporating non-linear directional surface texturing has a dimple diameter and the non-linear channels have channel widths that progressively increase with dimple diameter such that a first dimple has a first dimple diameter and a first channel width and a second dimple has a second dimple diameter and a second channel width, wherein the first dimple diameter is less than the second dimple diameter and the first channel width is less than the second channel width.

18. The golf ball of claim 13, wherein each of the dimples incorporating non-linear directional surface texturing has a dimple diameter and the non-linear channels have channel depths that progressively increase with dimple diameter such that a first dimple has a first dimple diameter and a first channel depth and a second dimple has a second dimple diameter and a second channel depth, wherein the first dimple diameter is less than the second dimple diameter and the first channel depth is less than the second channel depth.

* * * * *